United States Patent [19]

Ozawa

[11] 4,037,408

[45] July 26, 1977

[54] CYLINDER HEAD FOR MULTI-CYLINDER INTERNAL COMBUSTION ENGINE

[75] Inventor: Masahiro Ozawa, Fuchu, Japan

[73] Assignee: Fuji Jukogyo Kabushiki Kaisha, Tokyo, Japan

[21] Appl. No.: 636,558

[22] Filed: Dec. 1, 1975

[30] Foreign Application Priority Data

Dec. 26, 1974 Japan ..... 50-2486[U]

[51] Int. Cl.[2] ..... F01N 7/10

[52] U.S. Cl. ..... 60/282; 60/323; 123/191 A; 123/193 H

[58] Field of Search ..... 60/282, 272, 323; 123/191 A, 193 H

[56] References Cited

U.S. PATENT DOCUMENTS

| | | | |
|---|---|---|---|
| 2,257,631 | 9/1941 | Wahlberg | 60/323 |
| 3,457,723 | 7/1969 | Kerns | 60/282 |
| 3,577,727 | 5/1971 | Warren | 60/292 |
| 3,916,850 | 11/1975 | Date | 60/323 |

FOREIGN PATENT DOCUMENTS

| | | | |
|---|---|---|---|
| 2,323,793 | 11/1974 | Germany | 60/282 |

*Primary Examiner*—Douglas Hart
*Attorney, Agent, or Firm*—Martin A. Farber

[57] ABSTRACT

A cylinder head is disclosed which can reduce external connections between engine exhaust ports and an exhaust conduit having an exhaust purifier. The cylinder head comprises a casting block formed with a plurality of exhaust ports, with a common port and with a plurality of passages communicating at one end with the common port. Each of the passages communicate with one of the exhaust ports.

2 Claims, 7 Drawing Figures

CYLINDER HEAD FOR MULTI-CYLINDER INTERNAL COMBUSTION ENGINE

The present invention relates to a cylinder head for a multi-cylinder internal combustion engine, and also relates to an exhaust system including the cylinder head and an exhaust gas purifier such as a thermal reactor.

To reduce concentrations of toxic components in exhaust gases, it is a well known practice to place an exhaust gas purifier, such as a thermal reactor, on an exhaust conduit in flow communication with the exhaust gases in the exhaust conduit. It is known that the temperature of the exhaust gases must be maintained high so as to increase the conversion efficiency within the exhaust gas purifier. In a conventional exhaust system, the exhaust gases pass through exhaust ports, an exhaust manifold and an exhaust pipe before entering an exhaust gas purifier, and the temperature of the exhaust gases tend to decrease before the exhaust gases enter the exhaust gas purifier.

It is therefore an object of the present invention to solve the above mentioned problem encountered in the conventional exhaust system.

It is another object of the present invention to provide an exhaust system which can keep the exhaust gases at relatively high temperature.

It is still another object of the present invention to provide means by which external connections between the exhaust ports of a multi-cylinder internal combustion engine and an exhaust conduit having an exhaust gas purifier are simplified and reduced.

It is a specific object of the present invention to provide a cylinder head which can simplify and reduce the external connections between the exhaust ports of a multi-cylinder internal combustion engine and an exhaust conduit having an exhaust purifier.

These and other objects, features and advantages of the present invention will become clear from the following description in connection with the accompanying drawings, in which.

Referring to the accompanying drawings like reference numerals are used to designate like parts.

Figure 1:
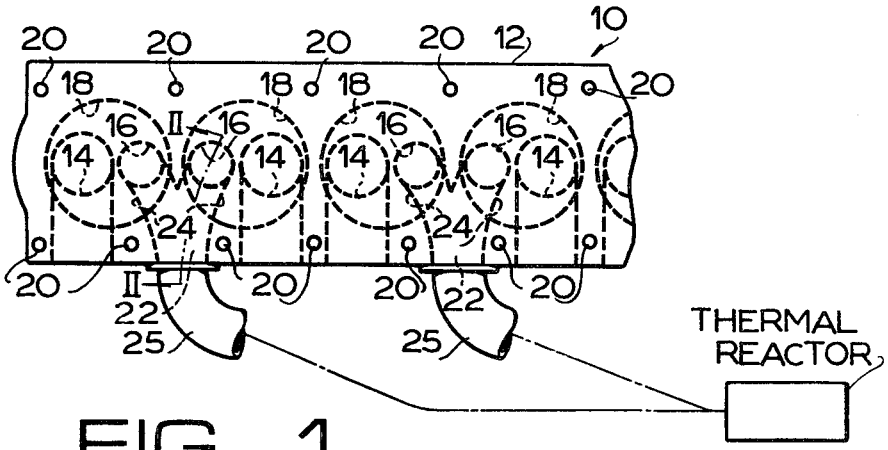
FIG. 1 is a schematic plan view of a multi-cylinder internal combustion engine with an exhaust system connected thereto, showing a cylinder head according to one embodiment of the present invention.

Referring particularly to FIG. 1 a cylinder head is diagrammatically shown and generally designated by 10. The cylinder head 10 is constructed of a casting block 12 formed with a plurality of intake ports 14 and a plurality of exhaust ports 16. The block 12 is fastened to an engine block, only cylinders of which are illustrated and designated by 18, by means of bolts 20. The intake ports 14 are arranged to communicate with the cylinders 18, respectively and the exhaust ports 16 are arranged to communicate with the cylinders 18, respectively, in the conventional manner. The casting block 12 is also formed with at least one common port 22 and with passages 24. The passages 24 communicate at one end with the common port 22 and lead from the common port 22 to the adjacent two exhaust ports 16. Each of the passages 24 communicates with one of the exhaust ports 16. The passages 24 communicating with one common port 22 may extend asynmetrically, with respect to the associated common port, in order to avoid the bolts 20. The common ports 22 are connected to an exhaust system, such as an exhaust manifold 25.

Figure 2:
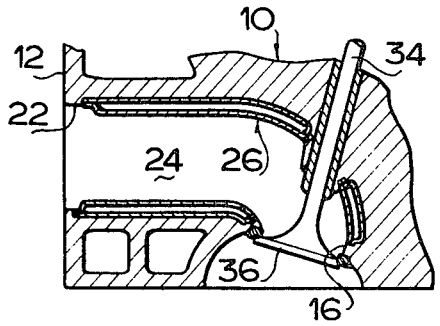
FIG. 2 is a sectional view taken through line II—II in FIG. 1.

Preferably, a liner generally designated by 26 is disposed in each of the passages 24 to increase the thermal capacity of the passage, as best seen in FIG. 2. The liner 26 is made of a suitable heat resisting metal and is formed integral with the block 12 by the casting process.

Figure 3:
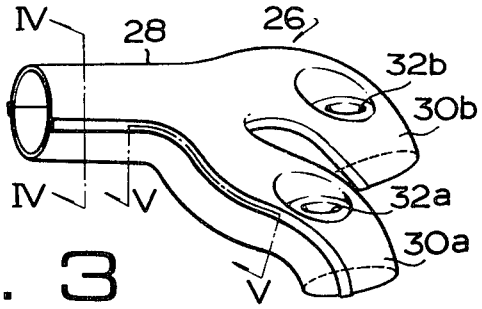
FIG. 3 is a perspective view of a liner used in FIG. 2.

As shown in FIG. 3, the liner 26 has a common passage 28 and two branch passages 30*a* and 30*b* bifurcated from the common passage 28. Each of the bifurcated branch passages 30*a* and 30*b* is formed with a hole 32*a* or 32*b* for permitting a stem 34 of an exhaust valve 36 of the popett type to pass therethrough.

Figure 4:
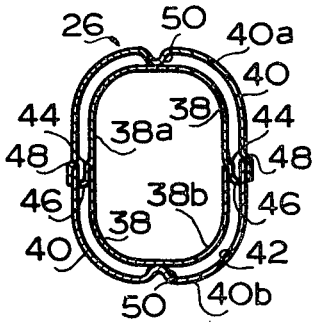
FIG. 4 is a sectional view taken through line IV—IV in FIG. 3.
Figure 5:
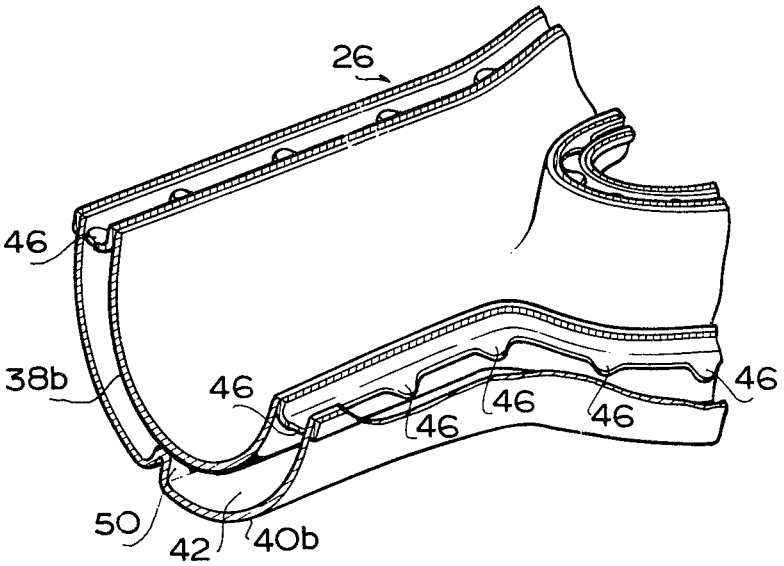
FIG. 5 is a sectional view taken through line V—V in FIG. 3.

As will be seen from FIGS. 4 and 5, the liner 26 is constructed of an inner shell 38 and an outer shell 40. The inner shell 38 is disposed in the outer shell 40 and spaced from the same to form an air layer 42 around the inner shell 38. The inner shell 38 consists of upper and lower halves 38*a* and 38*b* and the outer shell 40 of upper and lower halves 40*a* and 40*b.* The upper half 38*a* of the inner shell 38 is formed with offset portions 44 and the lower half 38*b* has its edges engaging the respective offset portions 44 and secured to the same by welding. The edges of the upper half 38*a* of the inner shell 38 are bent outwardly and terminate in a series of equally spaced, in the longitudinal direction, projecting teeth 46 which are in abutting engagement with the inner surface of the outer shell 40. The upper half 40*a* of the outer shell 40 is formed with offset portions 48 and the lower half 40*b* has its edges engaging the offset portion 48 and secured to the same by welding. The upper and outer halves 40*a* and 40*b* are formed with inwardly projecting protuberances 50 which are in abutting engagement with the outer surface of the inner shell 38. It is to be noted that with the outwardly projecting teeth 46 and inwardly projecting protuberances 50, the inner shell 38 is held in position within the outer shell 40 and the insulating air layer 42 is maintained around the inner shell 38.

Figure 6:
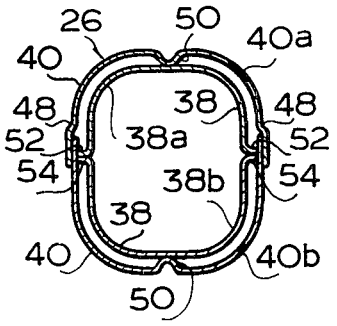
FIG. 6 is a similar view to FIG. 4 showing a modification of a liner.

FIG. 6 shows an alternative modification of a liner 26 which is different from that shown in FIG. 4 in that instead of offset portions 44 and outwardly projecting teeth 46, an upper half 38*a* of an inner shell 38 is formed with outwardly projecting edges 52 and a lower half 38*b* has outwardly projecting edges 54 secured to the edges 52 of the upper half 38 and secured to the same by welding. In this modification the outwardly projecting edges 52 and 54 abut with the inner surface of an outer shell 40.

The liner 26 constructed as described with reference to FIG. 3 - 5 or FIG. 5 is used as a core of the passages 24 during the casting process and is made integral with the casting block 12 (see FIG. 1).

Figure 7:
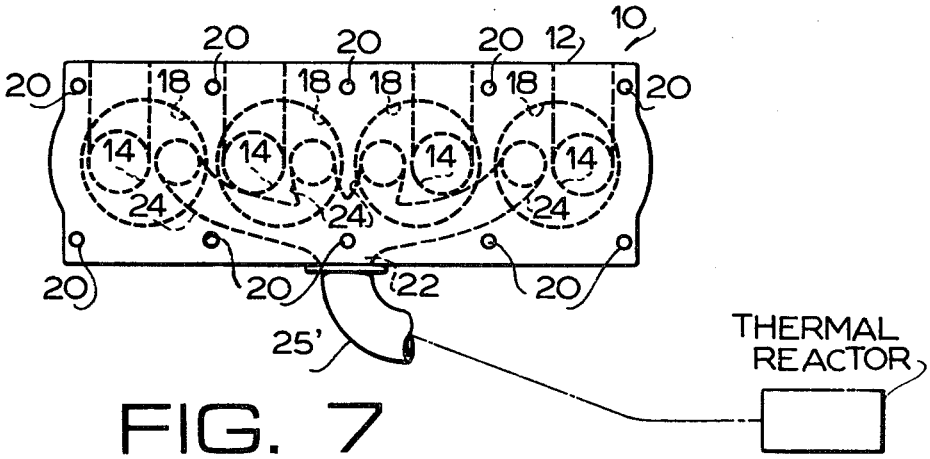
FIG. 7 is a similar view to FIG. 1 showing another embodiment.

FIG. 7 shows a second embodiment of the present invention. A cylinder head 10 is mounted to an engine block of a four cylinder engine and comprises a casting block 12 which is different from that shown in FIG. 1 in that all the passages 24 communicate at one end with a single common port 22 and an exhaust pipe 25' is directly connected to the single common port 22 eliminating the use of a conventional exhaust manifold.

It will now be seen from the preceding description that since at least two of or all of the exhaust ports 16 communicate with the common ports or single common port 22 (see FIGS. 1 and 7) by means of bifurcated passages 24 extending through the casting block 12 that is maintained at relatively high temperature during the operation of the engine, the exhaust gases before entering an exhaust purifier such as a thermal reactor or a catalytic converter will be maintained at relatively higher temperatures. It will also be seen that the use of the liner 26 will increase the thermal capacity of the passages 24. Therefore it will be appreciated as one of the advantages of the present invention that the exhaust gases will be maintained at relatively high temperatures in a location adjacent the inlet side of the exhaust purifier without increasing the complexity of an exhaust system.

Besides it will be seen that the construction of a exhaust manifold is simplified or the exhaust manifold may be eliminated according to the present invention. Therefore it will be appreciated as another advantage of the present invention that with the use of the cylinder head, an exhaust system is simplified.

What is claimed is:

1. A cylinder head for a multi-cylinder internal combustion engine comprising a block formed with a plurality of exhaust ports, with a common port adapted for connection to an exhaust system and with a plurality of passages communicating at one end with said common port, each of said passages communicating with one of said exhaust ports, a liner disposed in each of said passages, said liner comprising an inner shell and an outer shell, the inner shell being disposed in said outer shell and spaced from the same to form an air layer around said inner shell, said inner shell comprising a first half and a second half secured with each other and, in which said outer shell comprising a first half and a second half secured with each other, said first half of said inner shell has offset portions and said second half of said inner shell has edges thereof engaging the respective offset portions of said first half of said inner shell, in which said first half of said outer shell has offset portions and said second half of said outer shell has edges thereof engaging the respective offset portions of said first half of said outer shell, and in which said first half of said inner shell has outwardly projecting teeth abutting said outer shell and each of said first and second halves of said outer shell has inwardly projecting protuberances abutting said inner shell.

2. A cylinder head for a multi-cylinder internal combustion engine comprising a block formed with a plurality of exhaust ports, with a common port adapted for connection to an exhaust system and with a plurality of passages communicating at one end with said common port, each of said passages communicating with one of said exhaust ports, a liner disposed in each of said passages, said liner comprising an inner shell and an outer shell, the inner shell being disposed in said outer shell and spaced from the same to form an air layer around said inner shell, said inner shell comprising a first half and a second half secured with each other and, in which said outer shell comprising a first half and a second half secured with each other, said first half of said inner shell has outwardly projecting edges and said second half of said inner shell has outwardly projecting edges secured to the outwardly projecting edges of said first half of said inner shell, respectively, in which said first half of said outer shell has offset portions and said second half of said outer shell has edges thereof engaging the respective offset portions of said first half of said outer shell, and in which each of said first and second halves of said outer shell has inwardly projecting protuberances abutting said inner shell, said outwardly projecting edges of said first and second halves of said inner shell abutting said outer shell.

* * * * *